US005900604A

United States Patent [19]

McNeill

[11] Patent Number: 5,900,604

[45] Date of Patent: May 4, 1999

[54] PROGRESSIVE MINERAL REDUCTION WITH CLASSIFICATION, GRINDING AND AIR LIFT CONCENTRATION

[76] Inventor: Harry L. McNeill, 2625 E. Southern C231, Tempe, Ariz. 85282-7632

[21] Appl. No.: 08/820,483

[22] Filed: Mar. 18, 1997

[51] Int. Cl.[6] ..... B03B 7/00; B03B 9/00; B03D 1/02

[52] U.S. Cl. ..... 209/164; 209/166; 209/3; 209/12; 241/20; 241/24.13; 241/24.25; 241/24.1

[58] Field of Search ..... 209/3, 12, 17, 209/164, 166, 167; 241/20, 24.13, 24.25, 77, 78, 24.1

[56] References Cited

U.S. PATENT DOCUMENTS

| | | | |
|---|---|---|---|
| 2,931,502 | 4/1960 | Schoeld et al. . | |
| 3,928,182 | 12/1975 | Eder | 209/12 |
| 3,980,240 | 9/1976 | Nott | 241/20 |
| 4,460,459 | 7/1984 | Shaw et al. | 209/9 |
| 4,871,447 | 10/1989 | Adamache | 209/166 |
| 4,923,125 | 5/1990 | Bateson et al. | 241/20 |
| 4,960,509 | 10/1990 | McNeill | 209/164 |
| 4,964,981 | 10/1990 | Adamache | 209/166 |
| 5,282,538 | 2/1994 | Moys | 209/164 |
| 5,338,337 | 8/1994 | Johnson et al. | 75/654 |
| 5,456,362 | 10/1995 | Laskowski et al. | 209/164 |

FOREIGN PATENT DOCUMENTS

| | | |
|---|---|---|
| 854740 | 10/1970 | Canada . |

*Primary Examiner*—Thomas M. Lithgow
*Attorney, Agent, or Firm*—Sheridan Ross P.C.

[57] ABSTRACT

The present invention is a process for recovering valuable minerals using air lift concentration and progressive ore reduction. The ore is ground to a relatively coarse size, the ground ore is classified, and the underflow fraction floated to produce concentrate, middlings, and tailings fractions. The middlings fraction can be reground to liberate the valuable minerals and subjected to further air lift concentration. The classifier overflow fraction is passed through additional classifiers, the underflow fractions of which can be reground and refloated. The overflow fraction of the last classifier can be subjected to flotation to further enhance recovery.

20 Claims, 4 Drawing Sheets

PROGRESSIVE MINERAL REDUCTION WITH CLASSIFICATION, GRINDING AND AIR LIFT CONCENTRATION

FIELD OF THE INVENTION

The present invention relates generally to flotation processes and specifically to air lift flotation processes.

BACKGROUND OF THE INVENTION

One of the challenges in mineral recovery involves the separation (i.e., liberation) of a desired mineral from the ore in which it is contained. Mineral separation has been performed manually (i.e., by hand picking), gravity separation (e.g., jigs and tables), magnetic separation and froth flotation.

Froth flotation is the most common method of liberating the mineral from the other components of the ore. In flotation, the ore is ground to a relatively fine size, placed as a slurry in a froth flotation tank, and contacted with air bubbles. The chemical and physical properties of the desired and/or undesired (i.e., gangue) minerals (i.e., properties generally are the hydrophobicity and/or hydrophilicity of the minerals) are adjusted to cause either the desired or undesired minerals to attach to the air bubbles. The air bubbles carry the attached minerals upwards into a froth at the top of the slurry. The minerals which are not attracted to the air bubbles settle to the bottom of the tank due to gravity. The froth and attached materials are removed from the top of the tank (typically as the concentrate) and the settled materials from the bottom (typically as the tailings).

Flotation suffers from a number of problems. First, flotation can fail to provide the critical upward flow velocity required for the flotation of large particles. Typically, flotation systems rely on the adhesive forces between the bubble and particle to overcome the force of gravity pulling downwards on the particle. The forces of gravity pulling downwards on larger particles can exceed the adhesive force between the particles and the attached bubbles, thereby causing the larger particles to fall to the bottom of the tank. Second, flotation has a limited ability to recover occluded or partially occluded minerals in middlings particles. "Middling" typically are particles which contain minor amounts of a desired mineral attached to undesired minerals. Because the bubbles selectively attach to the mineral, the area for attachment in a middling particle is relatively small and can be easily overcome by gravitational forces. Finally, particles can be knocked loose from attached bubbles in flotation tanks having a high degree of slurry agitation.

Recently, a new concentration flotation technique, known as air lift concentration, has been developed. Air lift concentration is described in U.S. Pat. No. 4,960,509. In air lift concentration, an upward uniform flow of slurry in a flotation zone counteracts the downward flow of gravity on the particles. The greater the velocity of the uniform upward flow, the heavier the particles that can be floated.

There is a need for a concentration process having the ability to inexpensively produce a relatively high recovery of desired minerals from undesirable minerals. Related needs are to provide a concentration process having the ability to liberate undesired minerals from desired minerals and concentrate relatively large and/or heavy particles and middlings particles.

SUMMARY OF THE INVENTION

These and other needs are addressed by the air lift concentration process and circuit of the present invention.

Conventional flotation circuits worldwide require a grind somewhere between 35 and 65 mesh to unlock the mineral. This forms a dirty concentrate of free mineral and fine middling and a tailing that includes coarse middling and overground free mineral. The new process has progressive mineral reduction by classification, grinding, and air lift concentration. It is the most radical change in hydrometallurgy and in flotation in over 70 years.

This process requires a coarse reduction from about 8 to about 10 mesh on the ores already tested at Hazen Research in Golden, Colo. This untreated 8 to 10 mesh material contains coarse and fine waste rock, coarse and fine ore particles including middling, and some still unlocked hidden mineral.

Classification helps separate the ore from the waste rock including hidden mineral until the final classification which underflows coarse waste rock and overflows fine mineral and fine waste. The underflow from the first classifier goes to primary air lift concentration where the free mineral becomes clean final concentrate and the large middling concentrate goes to a final grind of about 150 mesh +/− using secondary air lift concentration to quickly remove free mineral and prevent its being overground. This second airlift concentration provides a clean final concentrate and a clean final tail. This new process requires that the middling is unlocked first, not the mineral.

In one embodiment of the present invention, the process includes the steps of: (a) comminuting (e.g., by crushing and/or grinding) a mineral-containing material to form a comminuted mineral-containing material; (b) separating (e.g., by screening and/or classifying) the mineral-containing material into separate coarse and fine fractions; and (c) forming (e.g., by air lift concentration) the coarse fraction into concentrate and tailings fractions. As used herein, "coarse" and "oversized" refer to material above a given size (i.e., for size separation) or specific gravity (i.e., for gravity separation). "Fine" and "undersized" refer to material below a given size or specific gravity. Most typically, these terms will refer to a product of size or gravity separation techniques. The minerals in the mineral-containing material can include sulfides such as chalcocite, chalcopyrite, covellite, potash, silicates and mixtures thereof.

The air lift concentration process can further include the steps of: (d) separating at least a portion of the tailings fraction to form separate oversized and undersized fractions; (e) comminuting at least a portion of the oversized fraction to form a comminuted oversized fraction; (f) separating at least a portion of the comminuted oversized fraction to form separate oversized coarse and oversized fine fractions; (g) forming oversized concentrate and tailings fractions from at least a portion of the oversized coarse fraction; (h) separating at least a portion of at least one of the oversized tailings and undersized fractions into separate secondary oversized and undersized fractions; (i) comminuting at least a portion of the secondary oversized fraction; (j) separating at least a portion of the secondary undersized fraction into separate tertiary oversized and undersized fractions; and (k) forming a tertiary undersized concentrate fraction from at least a portion of the tertiary undersized fraction. For heavy desired minerals, gravity separation can be used in the separation steps to enable middling particles and coarse and fine free minerals to be separated from undesired minerals.

The air lift concentration process, also referred to as progressive mineral reduction, liberates the middlings particles before liberating the minerals from the host material.

As used herein, a "middling particle" refers to a particle in which the desired mineral is exposed. This is achieved by air lift concentration of a relatively coarsely ground (e.g., about 8 to about 10 mesh (Tyler)) feed material. The feed material is predominantly middlings particles, a small amount of coarse free mineral, with the remainder being occluded mineral particles. The air lift concentrate can then be finely ground to liberate the mineral by conventional flotation. In contrast, conventional flotation floats a finely ground feed material, thereby liberating the mineral but failing to liberate the middlings particles. The middlings particles and their contained minerals are typically discarded as waste.

The circuit for the air lift concentration, or progressive mineral reduction, process includes the following components: means for comminuting a mineral-containing material to form a comminuted mineral-containing material; means for separating the mineral-containing material into separate coarse and fine fractions; and means for concentrating the coarse fraction to form concentrate and tailings fractions. The separating means can be a cyclone classifier, mechanical classifier, hydraulic classifier, or screen. The concentrating means is preferably an airlift concentrator.

The above-noted process can realize relatively high recovery rates of desired minerals and requires significantly less comminution compared to conventional concentration processes. Unlike conventional concentration processes, the above-noted process separates comminuted materials into coarse and fine fractions, preferably by gravity separation techniques, and air lift concentrates the coarse fraction, preferably by air lift concentration techniques, to form a concentrate containing desired minerals. The minerals are contained in relatively coarse particles and/or middling particles. The middling particles in the concentrate can be further comminuted to a relatively fine size to liberate the contained desired minerals and the minerals recovered by further air lift concentration. To further enhance desired mineral recovery, the tailings fraction can be separated into oversized and undersized fractions with the oversized fraction being subjected to further air lift concentration as described above to increase mineral recovery. Unlike conventional flotation processes, waste material is not ground to relatively fine sizes. Relatively coarse sizes are used in the air lift concentrating step (c) above to separate desired from undesired minerals. As will be appreciated, some mineral ores contain only 6 lbs. of desired minerals in each ton of rock. Floating the material at relatively coarse sizes rather than at relatively fine sizes can significantly reduce energy consumption in comminuting the material.

In another embodiment of the process, the process can include the steps of: (a) air lift concentrating at least a portion of the mineral-containing material to form concentrate and tails fractions; (b) separating at least a portion of the tails fraction into separate oversized and undersized fractions; and (c) comminuting at least a portion of the oversized fraction to form a comminuted oversized mineral-containing material. The process can further include one or more of the additional steps (d)–(k) set forth above.

The circuit for this embodiment includes the following components: (a) means for concentrating the mineral-containing material to form concentrate and tails fractions; (b) means for separating the tails fraction into separate coarse and fine fractions; and (c) means for comminuting the coarse fraction to form a comminuted mineral-containing material.

DETAILED DESCRIPTION

Figure 1:
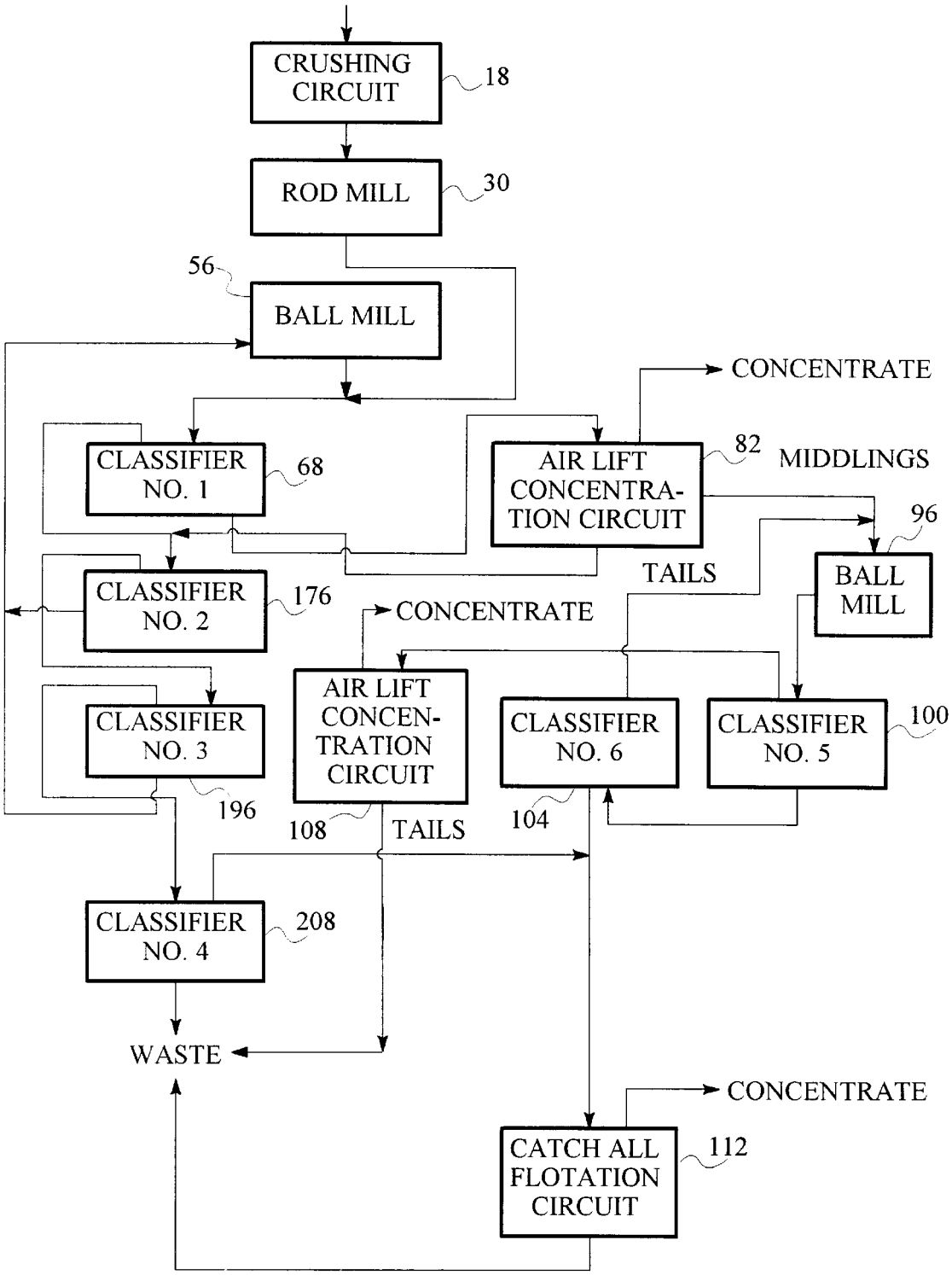
FIG. 1 is a flowchart of a circuit according to an embodiment of the present invention.
Figure 2A:
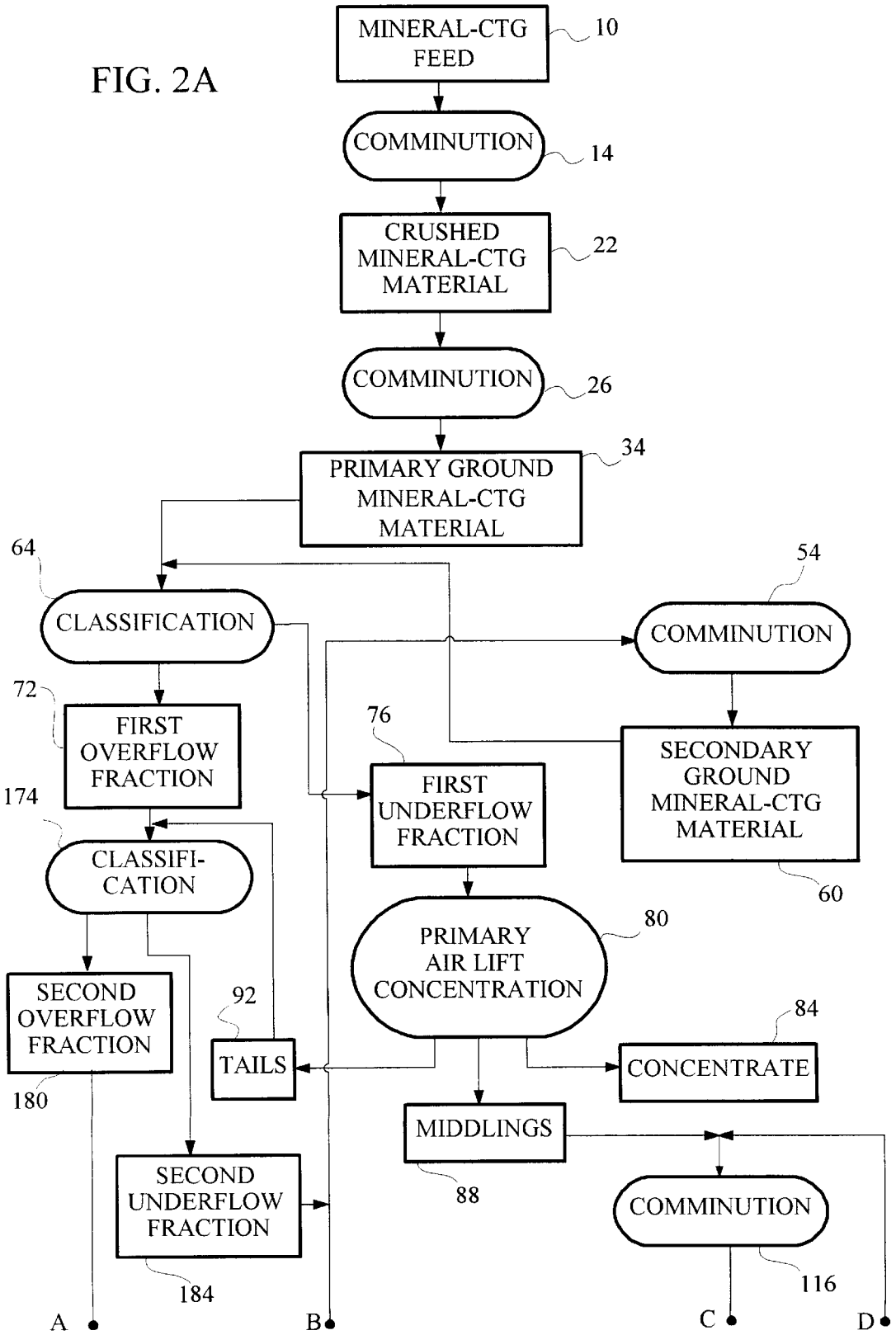
FIGS. 2A and B together are a flowchart of an air lift concentration process according to the embodiment of FIG. 1.
Figure 2B:
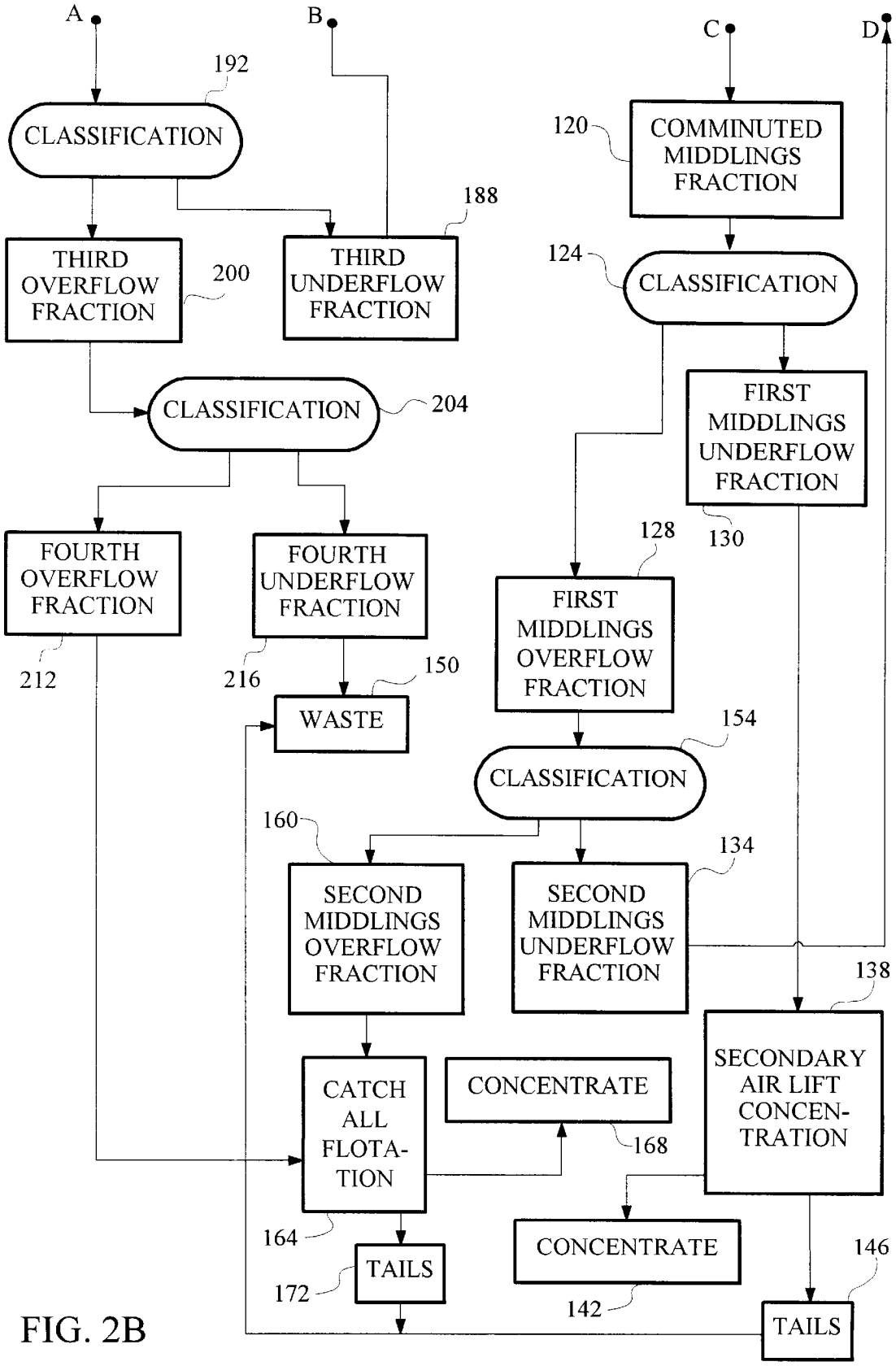
Figure 3:
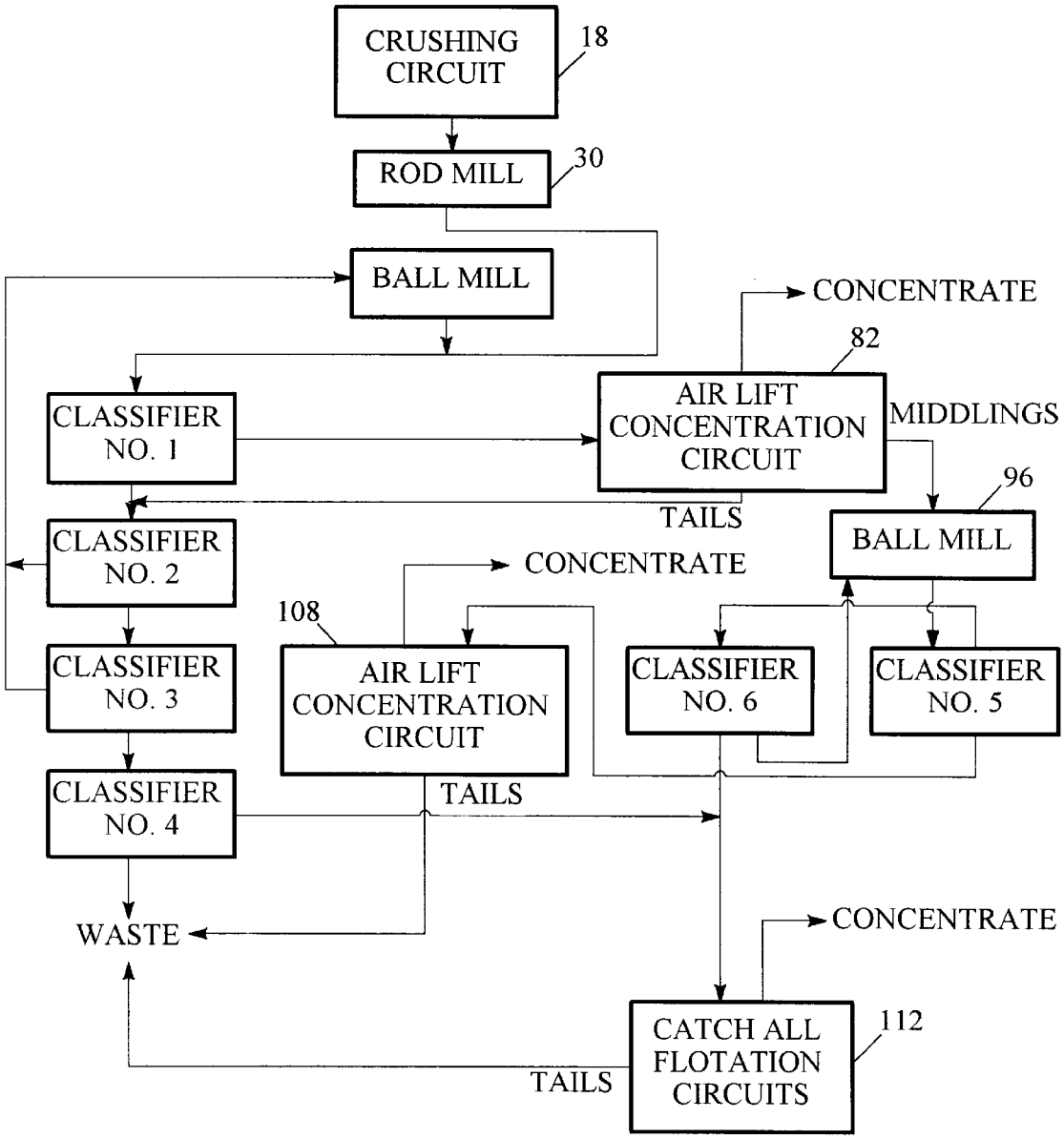
FIG. 3 is a flowchart of another embodiment of a circuit according to the present invention.

Referring to FIGS. 1 and 2, a mineral-containing feed material 10 is comminuted 14 in a crushing circuit 18 to form a crushed mineral-containing material 22.

The crushed mineral-containing material 22 is comminuted 26 in a rod mill 30 or other suitable grinding device to form a primary ground mineral-containing material 34. The primary ground mineral-containing material 34 preferably has a mean size ranging from about 6 to about 20 mesh (Tyler), and 80% by weight of the crushed mineral-containing material preferably has a $P_{80}$ size ranging from about 4 to about 10 mesh (Tyler) and more preferably from about 6 to about 10 mesh (Tyler).

The primary ground mineral-containing material 34 is combined with the secondary ground mineral-containing material 60 to form a combined feed material and classified 64 by a first classifier 68 into first overflow and underflow fractions 72 and 76. As will be appreciated, the classifiers 68, 176, 196, 104, 100 and 208 can be replaced by any suitable size or gravity separation device, such as a jig or gravity machine. Typically, the underflow fraction is no more than about 50% and more typically no more than about 25% by weight of the combined feed material. Preferably, the first underflow fraction 76 has a size preferably ranging from about 6 to about 25 mesh (Tyler) and more preferably from about 8 to about 10 mesh (Tyler) The spigot setting of the classifier 68 is selected such that at least about 80% of the desired mineral is contained in the underflow fraction. The $P_{80}$ size of the first underflow fraction 76 preferably ranges from about 4 to about 10 and more preferably from about 8 to about 10 mesh (Tyler).

The first underflow fraction 76 is air lift concentrated 80 in an air lift concentration circuit 82 to produce a concentrate fraction 84, a middlings fraction 88, and a tailings fraction 92 that includes hidden mineral. Air lift flotation techniques are set forth in U.S. Pat. No. 4,960,509, which is incorporated herein by this reference in its entirety. Chemicals, such as frothers, collectors, activators, depressants, and the like can be selected and added to the slurry in the flotation tank. Other factors such as feed rate, slurry density, the degree of agitation, aeration rate, slurry temperature, and the relative sizes of the flotation and feed zones can be selected as appropriate.

The middlings fraction 88 is further processed in a secondary recovery circuit to "unlock", or separate, the desired minerals from the gangue minerals in the middlings particles. The middlings fraction 88, which typically is about 25% and more typically about 5% by weight or less of the feed material 10, is combined with a second middlings underflow fraction 134, discussed below, and comminuted 116 to form a comminuted middlings fraction 120. Typically, the comminuted middlings fraction 120 constitutes no more than about 25% by weight of the feed material 10. The comminuted middlings fraction 120 has a size sufficiently small enough to liberate the desired mineral occluded in the middlings particles. The fraction 120 preferably has a mean size ranging from about 50 to about 250 mesh (Tyler), and the $P_{80}$ size ranges from about 100 to about 200 mesh (Tyler) and more preferably from about 100 to about 175 mesh (Tyler).

The comminuted middlings fraction 120 is classified 124 in the fifth classifier to form separate first middlings overflow and underflow fractions 128 and 130.

The first middlings underflow fraction 130 is subjected to air lift concentration 138 in an air lift concentration circuit 108 to form separate concentrate and tails fractions 142 and 146. The tails fraction 146 is discarded as waste material 150. As noted above, chemicals, such as frothers, collectors, activators, depressants, and the like can be selected and added to the slurry in the flotation tank. Other factors such as feed rate, slurry density, the degree of agitation, aeration rate, slurry temperature, and the relative sizes of the flotation and feed zones can be selected as appropriate.

The first middlings overflow fraction 128 is classified 154 in the sixth classifier 104 to form second middlings overflow and underflow fractions 160 and 134.

The second middlings underflow fraction 134 is subjected to further comminution 116 as noted above. The second middlings underflow fraction 134 constitutes typically no more than about 10% and more typically no more than about 5% by weight of the feed material 10.

The second middlings overflow fraction 160 is subjected to catch all flotation 164 in a catch all flotation circuit 112 to form separate concentrate and tails fractions 164 and 172. Flotation is preferably performed by conventional flotation techniques for finely ground material. The flotation is thus preferably not performed by air lift concentration techniques. Additives, such as chemicals (e.g., frothers, collectors, activators, and depressants) can be added to the slurry in the flotation tanks, and other factors such as feed rate, slurry density, the degree of agitation, aeration rate, slurry temperature, and the relative sizes of the flotation and feed zones can be selected as appropriate.

The tails fraction 172 can be combined with the tails fraction 146 and discarded as waste material 150.

Returning to FIGS. 1 and 2A, the first overflow fraction 72 is combined with the tails fraction 92 and classified 174 in a second classifier 176 to form second overflow and underflow fractions 180 and 184.

The second underflow fraction 184 is combined with a third underflow fraction 188 and comminuted 54 in the ball mill 96 as described above.

The second overflow fraction 180 is classified 192 by a third classifier 196 to form third overflow and underflow fractions 200 and 188.

As noted, the second underflow fraction 184, the third underflow fraction 188, and the coarse screen fraction 46 are combined and comminuted 54 in the ball mill 96 to form the secondary ground mineral-containing material 60.

The third overflow fraction 200 is classified 204 by a fourth classifier 208 to form fourth overflow and underflow fractions 212 and 216. Typically, the classifiers 68, 176, 196 and 208 have substantially the same spigot settings (i.e., perform separation at substantially the same specific gravity).

The fourth underflow fraction 216 is discarded as waste material 150.

The fourth overflow fraction 212 is subjected to catch all flotation 164 in the catch all circuit 112 as noted above.

The process described above can be modified depending upon the application. By way of example, other suitable comminution devices other than the rod mill 30 and ball mills 56 and 96 can be employed depending upon the application. More or fewer classifiers may be required depending upon the application to realize the desired recovery of valuable minerals. In yet other applications, other separation devices, such as screens, can be used instead of one or more of the classifiers to realize the desired recovery of such minerals. This is particularly the case where the specific gravity of the desired minerals is similar to the specific gravity of the gangue minerals. In the various air lift concentration and flotation steps, any number of flotation tanks can be employed in the circuits 82, 108, and 112, as desired. The classifiers 68, 82, 104, 176, 196, and 208 can have the same or progressively smaller settings. In the latter circuit configuration, the first classifier 68 performs a separation at a higher specific gravity (or coarser particle size) than the second classifier 176, the second classifier 176 than the third classifier 196, the third classifier 196 than the fourth classifier 208, the fourth classifier 208 than the fifth classifier 100, and the fifth classifier 100 than the sixth classifier 104. Thus, the specific gravity (or particle size) of separation of the sixth classifier 104 is the lowest of all of the classifiers.

While various embodiments of the present invention have been described in detail, it is apparent that modifications and adaptations of those embodiments are within the spirit and scope of the present invention, as set forth in the following claims.

What is claimed is:

1. A method for forming a concentrate of a desired mineral from a mineral-containing material, comprising:

(a) comminuting a mineral-containing material to form a comminuted mineral-containing material;

(b) separating at least a portion of the comminuted mineral-containing material into separate first coarse and first fine fractions;

(c) floating at least a portion of the first coarse fraction to form separate first concentrate, first middles and first tailings fractions;

(d) further comminuting at least a portion of the first middles fraction to form a further comminuted middles fraction;

(e) separating at least a portion of the further comminuted middles fraction to form second coarse and fine fractions;

(f) further floating at least a portion of the second coarse fraction to form separate second concentrate and tailings fractions; and (g) floating at least a portion of the second fine fraction to form separate third concentrate and tailings fractions, wherein at least about 80% by weight of the first coarse fraction has a particle size of at least about 25 mesh (Tyler).

2. The method of claim 1, wherein the comminuted mineral-containing material comprises at least a portion of the first tailings fraction.

3. The method of claim 1, further comprising:

(h) separating at least a portion of the second fine fraction into separate third coarse and fine fractions.

4. The method of claim 3, further comprising:

(i) further comminuting at least a portion of the third coarse fraction.

5. The method of claim 4, further comprising:

(j) separating at least a portion of the first tailings fraction into separate fourth coarse and fine fractions.

6. The method of claim 5, further comprising:

(k) floating at least a portion of the fourth fine fraction.

7. A method for forming a concentrate of a desired mineral from a mineral-containing material, comprising:

(a) comminuting a mineral-containing material to form a comminuted mineral-containing material;

(b) separating at least a portion of the comminuted mineral-containing material into separate first coarse and first fine fractions;

(c) floating at least a portion of the first coarse fraction to form separate first concentrate, first middles and first tailings fractions;

(d) further comminuting at least a portion of the first middles fraction to form a further comminuted middles fraction;

(e) separating at least a portion of the further comminuted middles fraction to form second coarse and fine fractions;

(f) further floating at least a portion of the second coarse fraction to form separate second concentrate and tailings fractions; and (g) floating at least a portion of the second fine fraction to form separate third concentrate and tailings fractions.

8. The method of claim 7, further comprising:

(h) separating at least a portion of the second fine fraction into separate third coarse and fine fractions.

9. The method of claim 8, further comprising:

(i) further comminuting at least a portion of the third coarse fraction.

10. The method of claim 9, further comprising:

(j) separating at least a portion of the first tailings fraction into separate fourth coarse and fine fractions.

11. The method of claim 10, further comprising:

(k) floating at least a portion of the fourth fine fraction.

12. The method of claim 7, wherein the comminuted mineral-containing material comprises at least a portion of the first tailings fraction.

13. The method of claim 7, wherein at least about 80% by weight of the first coarse fraction has a particle size of at least about 25 mesh (Tyler).

14. The method of claim 7, wherein the $P_{80}$ size of the comminuted mineral-containing material ranges from about 4 to about 10 mesh (Tyler).

15. The method of claim 7, wherein the comminuted mineral-containing material has a mean size ranging from about 6 to about 20 mesh (Tyler).

16. The method of claim 7, wherein the first middles fraction is about 25% by weight of the comminuted mineral-containing material.

17. The method of claim 7, wherein the first middles fraction has a mean size ranging from about 50 to about 250 mesh (Tyler).

18. The method of claim 7, wherein the first middles fraction has a $P_{80}$ size ranging from about 100 to about 200 mesh (Tyler).

19. The method of claim 7, wherein in the floating step (c) the at least a portion of the first coarse fraction has a substantially uniform upward flow in a flotation cell such that the force of gravity on particles in the at least a portion of the first coarse fraction is substantially negated by the upward flow of the particles.

20. A method for forming a concentrate of a desired mineral from a mineral-containing material, comprising:

(a) comminuting a mineral-containing material to form a comminuted mineral-containing material;

(b) separating at least a portion of the comminuted mineral-containing material into separate first coarse and fine fractions;

(c) floating at least a portion of the first coarse fraction to form separate first concentrate, middles and tailings fractions;

(d) further comminuting at least a portion of the first middles fraction to form a further comminuted middles fraction;

(e) separating at least a portion of the further comminuted middles fraction to form second coarse and fine fractions;

(f) further floating at least a portion of the second coarse fraction to form separate second concentrate and tailings fractions;

(g) floating at least a portion of the second fine fraction to form separate third concentrate and tailings fractions;

(h) separating at least a portion of the first tailings fraction into separate third coarse and fine fractions;

(i) further comminuting at least a portion of the third coarse fraction;

(j) separating at least a portion of the third fine fraction into separate fourth coarse and fine fractions; and (k) floating at least a portion of the fourth fine fraction.

* * * * *